US006093283A

United States Patent [19]

Palmgren et al.

[11] Patent Number: 6,093,283

[45] Date of Patent: Jul. 25, 2000

[54] SHOE PRESS AND METHOD FOR SUPPORTING A PRESS SHOE IN A SHOE PRESS

[75] Inventors: Joakim Palmgren, Karlstad; Mikael Nyman; Erik Brox, both of Forshaga, all of Sweden

[73] Assignee: Valmet-Karlstad AB, Sweden

[21] Appl. No.: 09/163,827

[22] Filed: Sep. 30, 1998

Related U.S. Application Data

[60] Provisional application No. 60/064,635, Nov. 7, 1997.

[30] Foreign Application Priority Data

Sep. 30, 1997 [SE] Sweden ..... 9703570

[51] Int. Cl.[7] ..... D21F 3/02

[52] U.S. Cl. ..... 162/205; 100/153; 162/358.3; 162/361; 492/7

[58] Field of Search ..... 162/205, 358.3, 162/358.4, 358.5, 361; 492/7; 100/153

[56] References Cited

U.S. PATENT DOCUMENTS 5,662,777 9/1997 Schiel et al. ..... 162/358.3
5,855,740 1/1999 Schiel ..... 162/358.3

FOREIGN PATENT DOCUMENTS 195 15 832C1 5/1996 Germany .

*Primary Examiner*—Karen M. Hastings
*Attorney, Agent, or Firm*—Alston & Bird LLP

[57] ABSTRACT

A method of supporting a press shoe in a shoe press for a paper or board machine, said press shoe forming together with a counter roll an extended nip for a paper or cardboard web and for a flexible circulated belt. On the outside of the loading cylinder of the press shoe there is arranged a compartment, to which hydraulic fluid is supplied in such a manner that the hydraulic fluid in the compartment directly or indirectly exerts a force upon the press shoe in the direction opposite to that of the force exerted upon the press shoe by the loading cylinder. The cylinder part of the loading cylinder is movably arranged on the piston part. Said forces are dimensioned such that in operation they create a gap between the press shoe and the loading cylinder, or between the supporting beam of the press shoe and the loading cylinder, thereby allowing hydraulic fluid to flow out of the compartment. In an embodiment of a shoe press as described above, the working chamber of the loading cylinder can communicate with the compartment via a throttle. Alternatively, the working chamber and the compartment can be supplied with hydraulic fluid independently of each other.

21 Claims, 2 Drawing Sheets

SHOE PRESS AND METHOD FOR SUPPORTING A PRESS SHOE IN A SHOE PRESS

CROSS-REFERENCE TO RELATED APPLICATION

This application claims priority from U.S. provisional application Ser. No. 60/064,635, filed Nov. 7, 1997.

FIELD OF THE INVENTION

The invention relates to a shoe press for pressing a running fibrous web in a paper or board machine, and to a method of supporting a press shoe in a shoe press.

BACKGROUND OF THE INVENTION

The invention concerns a shoe press for a paper or board machine, the shoe press having a press shoe which together with a counter roll forms an extended nip for a paper or cardboard web and for a flexible circulated belt. In such shoe presses, it is known to provide at least one piston-and-cylinder assembly arranged between a supporting beam associated with the frame system of the shoe press and the press shoe and in which hydraulic fluid is supplied to a working chamber. In some types of shoe presses, the working chamber of the piston-and-cylinder assembly communicates with a compartment via a throttle, the compartment being arranged on the outside of the piston-and-cylinder assembly in such a manner that the hydraulic fluid therein directly or indirectly exerts a force upon the press shoe in the direction opposite to that of the force exerted upon the press shoe by the hydraulic fluid in the working chamber.

A shoe press as described above is disclosed in DE 195 15 832 C1. The compartment is defined in a face of the piston of the piston-and-cylinder assembly.

This shoe press suffers from the drawback that lateral forces which in operation affect the press shoe are transmitted to the cylinder jacket and the piston, which may cause a jam between the press shoe and the piston.

SUMMARY OF THE INVENTION

The tendency of lateral forces exerted by a press shoe to be transmitted to the cylinder jacket and the piston has been reduced or eliminated by a method of supporting the press shoe and by a shoe press in accordance with the invention. The piston-and-cylinder assembly includes a fixed member which is fixed relative to one of the press shoe and supporting beam, and a movable member which is movable relative to the fixed member toward and away from the press shoe. A compartment is provided between an outer surface of the movable member and a bearing surface of the other of the press shoe and supporting beam. A working chamber of the piston-and-cylinder assembly is pressurized by hydraulic fluid so as to exert a force on the movable member in a direction to tend to move the movable member toward the other of the press shoe and supporting beam. The compartment is pressurized with hydraulic fluid so as to exert a force on the movable member in a direction tending to move the movable member away from the bearing surface. Sufficient hydraulic pressure is initially supplied to the compartment in relation to the pressure in the working chamber so that the movable member and the bearing surface become separated and a gap is created between the movable member and the bearing surface of the other of the press shoe and supporting beam. Hydraulic fluid is then continually supplied to the compartment so that hydraulic fluid continually flows out of the compartment through the gap. Accordingly, a fluid cushion or bearing exists between the press shoe and the piston-and-cylinder assembly, such that the piston-and-cylinder assembly is substantially isolated from lateral forces on the press shoe.

In one preferred embodiment, a piston of the piston-and-cylinder assembly is affixed to the press shoe and a cylinder of the piston-and-cylinder assembly is movably mounted on the piston. A face of the cylinder which confronts the supporting beam defines the compartment for receiving hydraulic fluid. In an alternative preferred embodiment, the piston is affixed to the supporting beam and the compartment defined in the face of the cylinder confronts the press shoe.

The working chamber and the compartment may be independently supplied with hydraulic fluid, or alternatively may be connected so that they are commonly supplied. Thus, in one preferred embodiment of the invention, the piston includes a hydraulic supply passage for supplying hydraulic fluid to the working chamber, and the other of the press shoe and supporting beam (i.e., the member adjacent the compartment) includes a separate hydraulic supply passage for supplying hydraulic fluid to the compartment. In an alternative preferred embodiment, the piston includes the hydraulic supply passage, and the cylinder member includes a passage which interconnects the working chamber and the compartment such that hydraulic fluid flows from the working chamber into the compartment. The compartment is sized to have a greater area upon which hydraulic pressure acts than that of the working chamber to facilitate creating an initial net force on the cylinder which acts to urge the cylinder and the other of the press shoe and supporting beam apart so as to establish the fluid bearing.

It will thus be appreciated that the invention provides unique shoe presses and methods of supporting a press shoe within a shoe press, which enable a press shoe to be hydraulically supported such that the piston-and-cylinder assemblies are substantially isolated from lateral forces exerted on the press shoe during operation.

BRIEF DESCRIPTION OF THE DRAWINGS

The above and other objects, features, and advantages of the invention will become more apparent from the following description of certain preferred embodiments thereof when taken in conjunction with the accompanying drawings, in which.

DETAILED DESCRIPTION OF PREFERRED EMBODIMENTS

Figure 1:
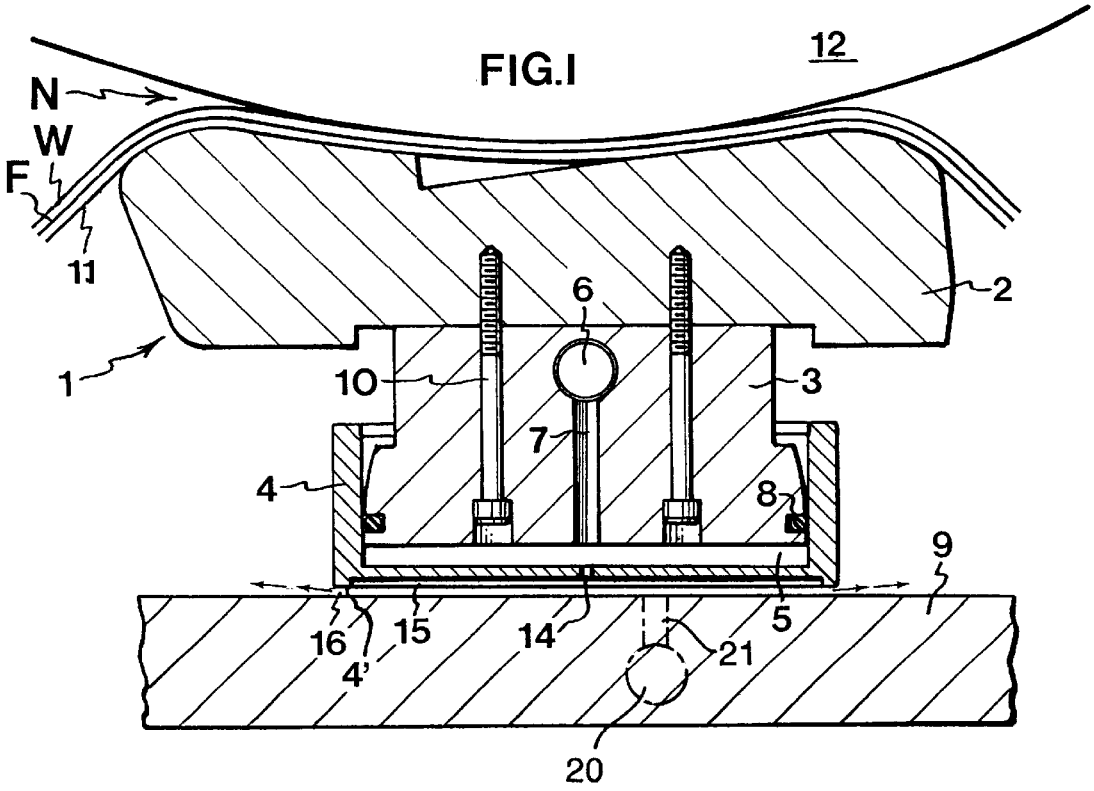
FIG. 1 is a cross-sectional view of a first embodiment of a shoe press according to the invention.

The present invention now will be described more fully hereinafter with reference to the accompanying drawings, in which preferred embodiments of the invention are shown. This invention may, however, be embodied in many different forms and should not be construed as being limited to the embodiments set forth herein; rather, these embodiments are provided so that this disclosure will be thorough and complete and will convey the scope of the invention to those skilled in the art. Like numbers refer to like elements throughout.

In the drawings, the cross-sectional views are taken transversely of the machine direction of the paper machine, and it is understood in this specification and in the claims that the press shoe is a single piece while there is at least one, and preferably more than one, piston-and-cylinder assemblies and several compartments distributed in the longitudinal direction of the press shoe (i.e., the cross-direction of the paper machine).

Figure 2:
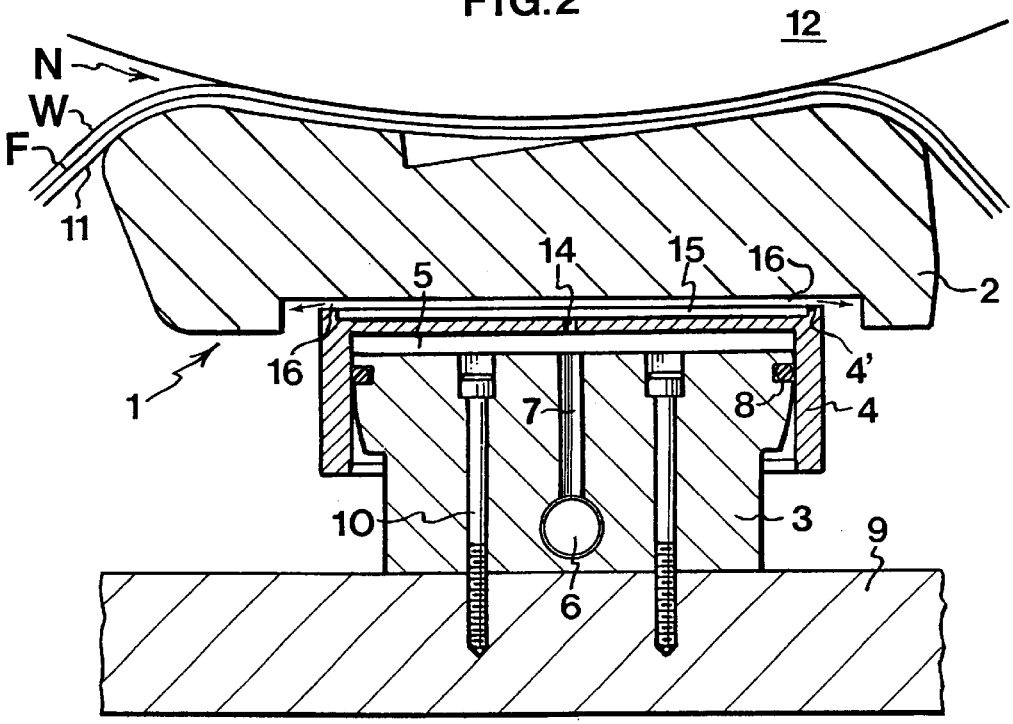
FIG. 2 is a cross-sectional view of a second embodiment of a shoe press according to the invention.

In FIGS. 1 and 2, reference numeral 1 designates two embodiments of a press shoe and reference numerals 2, 3, and 4 designate a press shoe, a piston, and a cylinder, respectively. The cylinder 4 and the piston 3 which is relatively movingly arranged therein define a working chamber 5, to which a hydraulic fluid, e.g. oil, is supplied from a duct 6 in the piston 3 via one or more bores 7 in the piston 3. A radial seal 8 is arranged for the sealing of the chamber 5. The piston 3 preferably is slightly tiltable in the cylinder 4.

Reference numeral 9 designates a horizontal supporting beam located in the shoe press and fixed to the frame. In the embodiment according to FIG. 1, the piston 3 is fixedly connected to the press shoe 2, and the end wall of the cylinder 4 rests freely on the beam 9, while in the embodiment according to FIG. 2, the piston 3 is fixedly connected to the beam 9 and the press shoe 2 rests freely on the end wall of the cylinder 4. Removable fasteners such as bolts 10 advantageously are used for affixing the piston 3 to either the press shoe 2 or supporting beam 9. The flexible press belt of the shoe press is designated 11, and the counter roll of the shoe press is designated 12.

In operation with the working chamber 5 pressurized, a paper web W and the circulated press belt 11 guided by the shoe press 1 pass through the nip N between the press shoe 2 and the counter roll 12, the felt F receiving water from the paper web W. The cylinder 4 is urged by pressure in the working chamber 5 in a direction tending to cause the cylinder 4 to contact a bearing surface of either the supporting beam (FIG. 1) or the press shoe 2 (FIG. 2) immediately opposite the end wall of the cylinder.

However, in the end wall of the cylinder 4 there is arranged a passage or throttle 14 which opens into a shallow compartment or pressure chamber 15 in the end wall of the cylinder 4. Hydraulic fluid in the chamber 5 may thus escape into the compartment 15 via the throttle 14. Pressure exerted by hydraulic fluid in the compartment 15 causes a force on the cylinder 4 tending to urge it away from the bearing surface of the supporting beam (FIG. 1) or of the press shoe (FIG. 2). This force is counteracted by the force exerted by the fluid in the working chamber 5. The area of the compartment 15 is somewhat larger than the inner area of the cylinder 4. Accordingly, when starting from a rest condition with the annular surface 4' of the cylinder 4 contacting the bearing surface of the opposite member, fluid initially supplied into the working chamber 5 and compartment 15 will cause the force exerted upon the cylinder 4 by the hydraulic fluid in the compartment 15 to overcome the force exerted on the cylinder 4 by the hydraulic fluid in the working chamber 5. As a result, the cylinder 4 is urged away from the supporting beam 9 such that a gap 16 is created between the annular bottom surface 4' of the cylinder 4 and the beam 9 (FIG. 1). Alternatively, where the piston 3 is affixed to the supporting beam 9, the net force on the cylinder 4 causes a gap to be formed between the annular top surface 4' of the cylinder 4 and the press shoe 2 (FIG. 2). Hydraulic fluid is then continually supplied into the working chamber 5, and thus into the compartment 15 via the throttle 14, so that fluid constantly flows through the gap 16 out of the compartment 15. Accordingly, the press shoe 2 floats freely upon a fluid cushion or bearing. In operation, there is thus a supporting and lubricating hydraulic fluid film in the gap 16, which can be said to define a fluid bearing between the upper side of the beam 9 and the annular surface 4' in FIG. 1 and between the underside of the press shoe 2 and the annular surface 4' in FIG. 2. A person skilled in the art will, without inventive effort, adapt the diameter of the throttle 14 and the area of the compartment 15 to each other, thereby obtaining a suitable film thickness.

Figure 3:
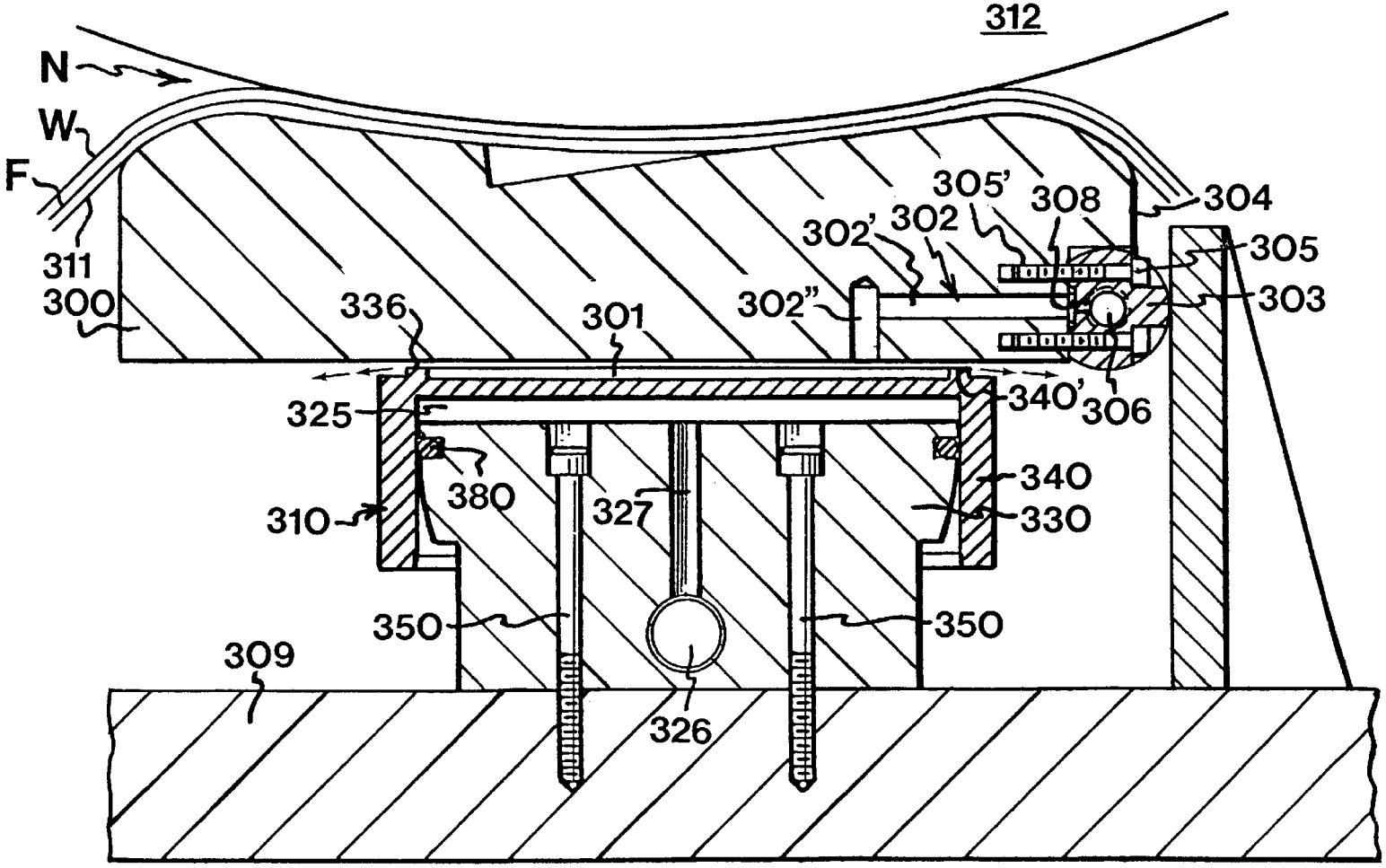
FIG. 3 is a cross-sectional view of a third embodiment of a shoe press according to the invention.

FIG. 3 illustrates a shoe press having a press shoe 300, a counter roll 312, a circulated press belt 311, a piston-and-cylinder assembly 310 with piston 330 and cylinder 340, and a beam 309 which is fixed to the frame. A seal ring 380 seals the connection between the piston 330 and the cylinder 340. The piston 330 is attached to the beam 309 by fasteners such as bolts 350. The top face of the movable cylinder 340 adjoins the press shoe 300, and in this top face there is a compartment or hydraulic fluid chamber 301, which is defined by an annular flange with an annular surface 340' on the top of the cylinder 340. The compartment 301 is supplied with hydraulic fluid via a sectional pipe 303 which is attached to the longitudinal side edge 304 of the press shoe 300 and which has an inner duct 306. A bore 302 is formed in the press shoe 300 and has bore portions 302' and 302" which are perpendicular to each other. The pipe 303 has an opening 308 which is formed in its wall and constitutes a throttle, and the opening 308 is aligned with the bore portion 302'. The sectional pipe 303 is releasably attached to the press shoe 300 by fasteners such as screws 305 which are received in threaded bores 305' in the press shoe.

The working chamber 325 of the piston-and-cylinder assembly 310 is supplied with hydraulic fluid via a duct system 326, 327 in the piston 330. However, there is no connection between the compartment 301 and the working chamber 325, but rather the compartment 301 and the working chamber 325 are separately supplied with hydraulic fluid. Thus, the compartment 301 is supplied via the pipe 303 and bore 302, and the working chamber 325 is supplied via the ducts 326, 327 in the piston 330. This arrangement makes it possible to form a gap 336 between the underside of the press shoe 300 and the annular top face 340' of the cylinder 340, through which gap hydraulic fluid can flow out of the compartment 301 while forming a fluid bearing, even if, as illustrated, the surface area of the compartment 301 is smaller than the inner area of the cylinder 340. For example, hydraulic fluid may be supplied to the compartment 301 at a greater pressure than that supplied to the working chamber 325.

In the type of arrangement shown in FIG. 1, the hydraulic fluid to the compartment 15 could be separately supplied by a duct 20 via a bore 21 (both shown in dashed lines) formed in the beam 9, instead of through the throttle 14.

Although the invention has been described in connection with a shoe press for use in a press section of a papermaking machine, the invention is also applicable to a pressing device in a calender section of a papermaking machine.

Many modifications and other embodiments of the invention will come to mind to one skilled in the art to which this invention pertains having the benefit of the teachings presented in the foregoing descriptions and the associated drawings. For example, while the invention has been explained in connection with piston-and-cylinder assemblies for creating the force urging the press shoe toward the counter roll, other types of force actuators may be used instead for creating such force. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A shoe press for pressing a running fibrous web against a counter roll, comprising:

a press shoe having a first side adapted to coact with the counter roll to form an extended nip through which the web is passed;

a supporting beam spaced from the press shoe on a second side thereof opposite from the counter roll;

at least one piston-and-cylinder assembly disposed between the supporting beam and the press shoe, the piston-and-cylinder assembly including a tubular cylinder and a piston slidably received in the cylinder so as to define a working chamber pressurizable by hydraulic fluid, one of the piston and the cylinder being a fixed member affixed to one of the press shoe and the supporting beam and the other of the piston and cylinder being movable such that pressurization of the working chamber causes a first force to be exerted on the movable member tending to urge the movable member toward a bearing surface of the other of the press shoe and supporting beam;

the movable member having a face defining a compartment pressurizable by hydraulic fluid and bounded on one side by the bearing surface such that the hydraulic fluid exerts a second force on the movable member in a direction opposite the first force; and a throttle interconnecting the working chamber and the compartment such that hydraulic fluid in the working chamber flows under pressure to the compartment;

the working chamber, compartment, and throttle being configured such that hydraulic fluid continually supplied into the working chamber flows through the throttle into the compartment and out of the compartment via a gap between the movable member and the bearing surface such that a fluid bearing is created between the piston-and-cylinder assembly and the bearing surface.

2. The shoe press of claim 1, wherein the piston is the fixed member and the cylinder is the movable member, the cylinder having an end wall which defines the face having the compartment.

3. The shoe press of claim 2, wherein the piston is affixed to the press shoe and the face of the cylinder having the compartment confronts the supporting beam.

4. The shoe press of claim 2, wherein the piston is affixed to the supporting beam and the face of the cylinder having the compartment confronts the press shoe.

5. The shoe press of claim 2, wherein the working chamber has an area over which hydraulic pressure acts to create the first force and the compartment has an area over which hydraulic pressure acts to create the second force, and wherein the area of the compartment is greater than the area of the working chamber.

6. The shoe press of claim 2, wherein the piston includes a supply passage which opens into the working chamber for supplying hydraulic fluid thereinto.

7. The shoe press of claim 2, wherein the throttle comprises a passage extending through the end wall of the cylinder, opposite ends of the passage opening into the working chamber and the compartment.

8. A shoe press for pressing a running fibrous web against a counter roll, comprising:

a press shoe having a first side adapted to coact with the counter roll to form an extended nip through which the web is passed;

a supporting beam spaced from the press shoe on a second side thereof opposite from the counter roll;

at least one piston-and-cylinder assembly disposed between the supporting beam and the press shoe, the piston-and-cylinder assembly including a tubular cylinder and a piston slidably received in the cylinder so as to define a working chamber pressurizable by hydraulic fluid, the piston being affixed to one of the press shoe and the supporting beam and the cylinder being movable relative thereto;

the cylinder having a face defining a compartment pressurizable by hydraulic fluid and bounded on one side by a bearing surface of the other of the press shoe and the supporting beam such that the hydraulic fluid exerts a force on the cylinder in a direction so as to create a gap between the cylinder and the bearing surface such that fluid flows continually out of the compartment through the gap so that a fluid bearing is created between the cylinder and the bearing surface to move the cylinder away from the bearing surface;

a supply passage formed in the piston and opening into the working chamber for supplying hydraulic fluid thereinto; and a duct formed in the other of the press shoe and supporting beam, the duct opening into the compartment for supplying hydraulic fluid thereinto independently of the working chamber.

9. The shoe press of claim 8, wherein the piston is affixed to the press shoe and the face of the cylinder having the compartment confronts the supporting beam.

10. The shoe press of claim 8, wherein the piston is affixed to the supporting beam and the face of the cylinder having the compartment confronts the press shoe.

11. The shoe press of claim 10, wherein the duct is formed in the press shoe and has an entrance defined in an outer surface of the press shoe, and further comprising a supply pipe releasably attached to the press shoe, a wall of the supply pipe having an opening therethrough aligned with the entrance to the duct for supplying hydraulic fluid from the supply pipe into the duct.

12. A method of supporting a press shoe in a shoe press having a supporting beam spaced from the press shoe and a piston-and-cylinder assembly disposed between the supporting beam and the press shoe, the piston-and-cylinder assembly including a tubular cylinder and a piston slidably received in the cylinder to define a working chamber, the method comprising the steps of:

providing one of the piston and the cylinder as a fixed member affixed to one of the press shoe and supporting beam, and providing the other of the piston and the cylinder as a movable member which is movable relative to the press shoe and supporting beam;

configuring a face of the movable member which confronts the other of the press shoe and supporting beam to have a compartment which is bounded on one side by a bearing surface of the other of the press shoe and supporting beam;

pressurizing the compartment with hydraulic fluid to momentarily cause a force to be exerted on the movable member which urges the movable member away from the bearing surface so as to create a gap between the movable member and the bearing surface; and continually supplying hydraulic fluid into the compartment such that the fluid continually flows out of the compartment through the gap to maintain a fluid bearing between the movable member and the bearing surface.

13. The method of claim 12, wherein the providing step comprises providing the cylinder as the fixed member and providing the piston as the movable member.

14. The method of claim 12, wherein the providing step comprises providing the piston as the fixed member and providing the cylinder as the movable member.

15. The method of claim 14, further comprising the step of supplying hydraulic fluid into the working chamber, and wherein the steps of pressurizing and supplying the compartment comprise supplying pressurized hydraulic fluid from the working chamber into the compartment by a passage which interconnects the working chamber and the compartment.

16. The method of claim 14, further comprising the step of supplying hydraulic fluid into the working chamber, and wherein the working chamber and compartment are independently supplied with hydraulic fluid.

17. The method of claim 16, wherein the working chamber is supplied with hydraulic fluid at a first pressure and the compartment is supplied with hydraulic fluid at a second pressure greater than the first pressure.

18. A shoe press for pressing a running fibrous web against a counter roll, comprising:

a press shoe having a first side adapted to coact with the counter roll to form an extended nip through which the web is passed;

a supporting beam spaced from the press shoe on a second side thereof opposite from the counter roll;

at least one force actuator disposed between the supporting beam and the press shoe and operable to provide a force urging the press shoe toward the counter roll, the force actuator having a first end affixed to one of the press shoe and supporting beam and a second end which confronts a bearing surface of the other of the press shoe and supporting beam, the second end defining a face;

a compartment formed in the face and bounded on one side by the bearing surface of the other of the press shoe and the supporting beam; and a supply passage for supplying hydraulic fluid into the compartment;

the compartment being dimensioned and the supply passage being arranged such that fluid pressure within the compartment is capable of moving the face away from the bearing surface so as to establish a gap therebetween, and such that the gap is maintainable by continually supplying hydraulic fluid through the supply passage into the compartment such that fluid continually flows out of the compartment through the gap.

19. The shoe press of claim 18, wherein the first end of the force actuator is affixed to the press shoe and the face of the force actuator having the compartment confronts the supporting beam.

20. The shoe press of claim 18, wherein the first end of the force actuator is affixed to the supporting beam and the face of the force actuator having the compartment confronts the press shoe.

21. The shoe press of claim 18, wherein the force actuator comprises a piston-and-cylinder assembly.

* * * * *

UNITED STATES PATENT AND TRADEMARK OFFICE
CERTIFICATE OF CORRECTION

PATENT NO. : 6,093,283

DATED : July 25, 2000

INVENTOR(S) : Palmgren et al.

It is certified that error appears in the above-identified patent and that said Letters Patent is hereby corrected as shown below:

Column 6, line 18, after "direction" insert --to move the cylinder away from the bearing surface--; lines 22-23, cancel "to move the cylinder away from the bearing surface".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*